US006908350B1

(12) United States Patent
Roessler et al.

(10) Patent No.: US 6,908,350 B1
(45) Date of Patent: Jun. 21, 2005

(54) TRIM APPARATUS FOR MARINE OUTDRIVE WITH STEERING CAPABILITY

(75) Inventors: Edmund B. Roessler, Providence, RI (US); Gregory P. Platzer, Hollywood, FL (US); Richard K. Sparks, Margate, FL (US)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 10/776,566

(22) Filed: Feb. 11, 2004

(51) Int. Cl.[7] ..... B63H 5/125
(52) U.S. Cl. ..... 440/61 R
(58) Field of Search ..... 440/49, 53, 61 S, 440/57, 51, 61 R, 61 T

(56) References Cited

U.S. PATENT DOCUMENTS 2,755,766 A * 7/1956 Wanzer ..... 440/57
3,888,203 A * 6/1975 Lohse ..... 440/57
3,933,116 A 1/1976 Adams et al. ..... 115/35
4,449,945 A * 5/1984 Ferguson ..... 440/53
4,544,362 A 10/1985 Arneson ..... 440/61
4,645,463 A 2/1987 Arneson ..... 440/57
5,290,182 A 3/1994 Mondelop ..... 440/57
5,549,493 A 8/1996 Bezzi ..... 440/61

* cited by examiner

*Primary Examiner*—Ed Swinehart
(74) *Attorney, Agent, or Firm*—Davis & Bujold, P.L.L.C.

(57) ABSTRACT

A marine outdrive (2) steering and trim system comprising a support linkage (26) which is either of fixed length (non-trimmable) or of an adjustable telescoping length (trimmable) and having a first end (28) pivotally mounted to the transom (4) and a second opposed end (30) attached to a propeller end (16) of the marine outdrive (2). A pair of steering actuators (42, 44) are connected between a steering yoke (38), secured to the support linkage (26), and a stationary pivot point on the transom (4) for providing a pure force couple to facilitating steering of the marine outdrive (2).

20 Claims, 9 Drawing Sheets

TRIM APPARATUS FOR MARINE OUTDRIVE WITH STEERING CAPABILITY

FIELD OF INVENTION

The present invention relates to improvements concerning a steering and trim apparatus for a marine outdrive system.

BACKGROUND OF INVENTION

U.S. Pat. No. 3,933,116 describes and shows a steering and trim apparatus for a marine device. According to this invention, a propeller shaft bearing box is horizontally pivoted in a gimbal ring, and the ring is vertically pivoted in the gimbal support frame. A tiller is secured on the gimbal ring vertical pivot shaft for horizontally swinging the propeller shaft to control steering. As shown in the drawings of that patent, the steering tiller is brought forward into the hull through an enlarged opening which must be sealed if the hull is submerged below this point. It is also evident in the general arrangement of this invention that the steering tiller is not suitable for counteracting large side forces typically generated by high performance marine outdrives.

U.S. Pat. No. 4,544,362 and U.S. Pat. No. 4,645,463 describe alternative steering and trim apparatuses for marine outdrives. As with U.S. Pat. No. 3,933,116, a telescoping linkage connects the outdrive with the hull and is used to vertically support the outdrive and provide trim capability. One or two additional telescoping linkages are similarly configured on the sides of the outdrive to provide steering capability for the outdrive. In order to provide a reasonable lever arm, the transverse location of the mounting points on the hull must be at a substantial distance from the center of the outdrive. In many applications, space limitations and the typical hull geometry allow only one steering linkage per outdrive to be used. In these cases, a substantial portion of the hydraulic force generated by the steering linkage is not applied in the direction required for steering thereby resulting in a large undesirable force being applied along the axis of the drive. These configurations also result in the hydraulic steering and trim cylinders being exposed to the marine environment and experience undesirable bending and torsional loads in addition to providing forces along the cylinder axis. The hydraulic cylinders, associated with the hydraulic lines and the position sensors, are also exposed to the marine environment.

U.S. Pat. No. 5,290,182 describes an alternative steering and trim apparatus for a marine outdrive which uses a single telescoping link between the outdrive and the hull to provide both trim and steering capability. As with the above discussed prior art, an external hydraulic cylinder is used for providing the trim capability. An external cylinder which must counteract torsional and bending loads from the outdrive and is exposed to the marine environment. A steering lever arm in combination with an "articulation ball" provides an internal tiller arrangement form steering. The "articulation ball" provides sealing for penetration of the tiller arm. It is noted that the combination of a tiller arm and the "articulation ball" results in a side reaction force on the ball whose magnitude is similar to the required steering force at the tiller arm. Designing to accommodate this forces would tend to result in a heavy apparatus for high performance marine outdrives.

U.S. Pat. No. 5,549,493 describes an alternative steering and trim apparatus for a marine outdrive, similar to the above arrangements, but where the single linkage between the outdrive and the hull has a fixed geometry and means are provided for steering and trim with internal mechanisms. This embodiment also uses an "articulating ball which seals the steering arm from the marine environment and absorbs large steering reaction forces. This arrangement has the advantage of moving all hydraulic and position sensor equipment inside the hull and separating those components from the marine environment. However, dealing with the associated design loads results in a fairly heavy apparatus which requires significant interior space.

SUMMARY OF THE INVENTION

Wherefore, it is an object of the present invention to overcome the above mentioned shortcomings and drawbacks associated with the prior art steering and trim marine outdrives.

An object of the present invention is to provide a marine outdrive steering and trim system comprising a support linkage, of either fixed length (non-trimmable) or telescoping length (trimmable), attached to the outdrive and pivotally mounted to the transom of the hull. A pair of steering actuators are connected between a stationary point on the transom and a steering yoke fixed to the support linkage for providing a pure force couple for steering of the outdrive.

Another object of the present invention is to provide a steering and trim marine outdrive system in which the steering and trim actuators are compact and light weight with high mechanical efficiency but without the steering and trim actuators being subjected to undesirable torsional or bending loads.

A further object of the invention is to provide a steering and trim marine outdrive system which does not require a significant amount of interior space or area for accommodating the steering actuators.

Still another object of the present invention is to provide a support linkage connected with the steering actuators via a steering yoke to facilitate steering of the marine outdrive by movement of the steering yoke connected with the support linkage.

Yet another object of the present invention is to minimize exposure to the various hydraulic conduits and electrical wires, of the marine outdrive, to harsh marine conditions by accommodating as many of those components as possible within the interior of the marine vessel.

A still further object of the present invention is to provide a pair of ball and socket assemblies, for the support linkage and the marine outdrive, which facilitate pivoting movement of the propeller end of the marine outdrive relative to the remainder of the marine outdrive which is securely affixed to the transom.

A further object of the present invention is to provide a compact steering and trim adjustment arrangement for a marine outdrive which is relatively simple to manufacture and service but isolates the cylinder of the support linkage, accommodating the movable linkage piston, from any excess steering and bending loads.

The present invention also relates to a steering and trim system for a marine outdrive comprising: a marine outdrive having a propeller end for supporting a rotatable propeller and a mounting end for mounting the marine outdrive to a marine vessel; a support linkage having a first end for attachment to a transom and a second end attached to the marine outdrive adjacent the propeller end thereof; a steering yoke supported adjacent the first end of the support linkage; and first and second spaced apart steering actuators, a first end of each of the first and second steering actuators coupled to the steering yoke and a second end of each of the first and second steering actuators being connectable with the transom for facilitating steering of the marine outdrive.

The present invention also relates to a method of steering a marine outdrive comprising the steps of: supporting a rotatable propeller at propeller end of a marine outdrive, and mounting an opposite end of the marine drive to a marine vessel; attaching a first end of a support linkage to a transom and attaching a second end of the support linkage adjacent the propeller end of the marine outdrive; supporting a steering yoke adjacent the first end of the support linkage; connecting a first end of each of first and second steering actuators with the steering yoke and connecting a second end of each of the first and second steering actuators with the transom such that the first and second steering actuators are spaced apart from one another; and controlling steering of the marine outdrive by simultaneously actuating the first and second steering actuators in opposite directions to cause the support linkage to pivot relative to the transom and steer the marine outdrive.

BRIEF DESCRIPTION OF THE DRAWINGS

For a more complete understanding of the present invention, and the advantages thereof, reference may be made to the following written description of exemplary embodiments, taken in conjunction with the accompanying drawings, in which.

DETAILED DESCRIPTION OF THE INVENTION

Figure 1:
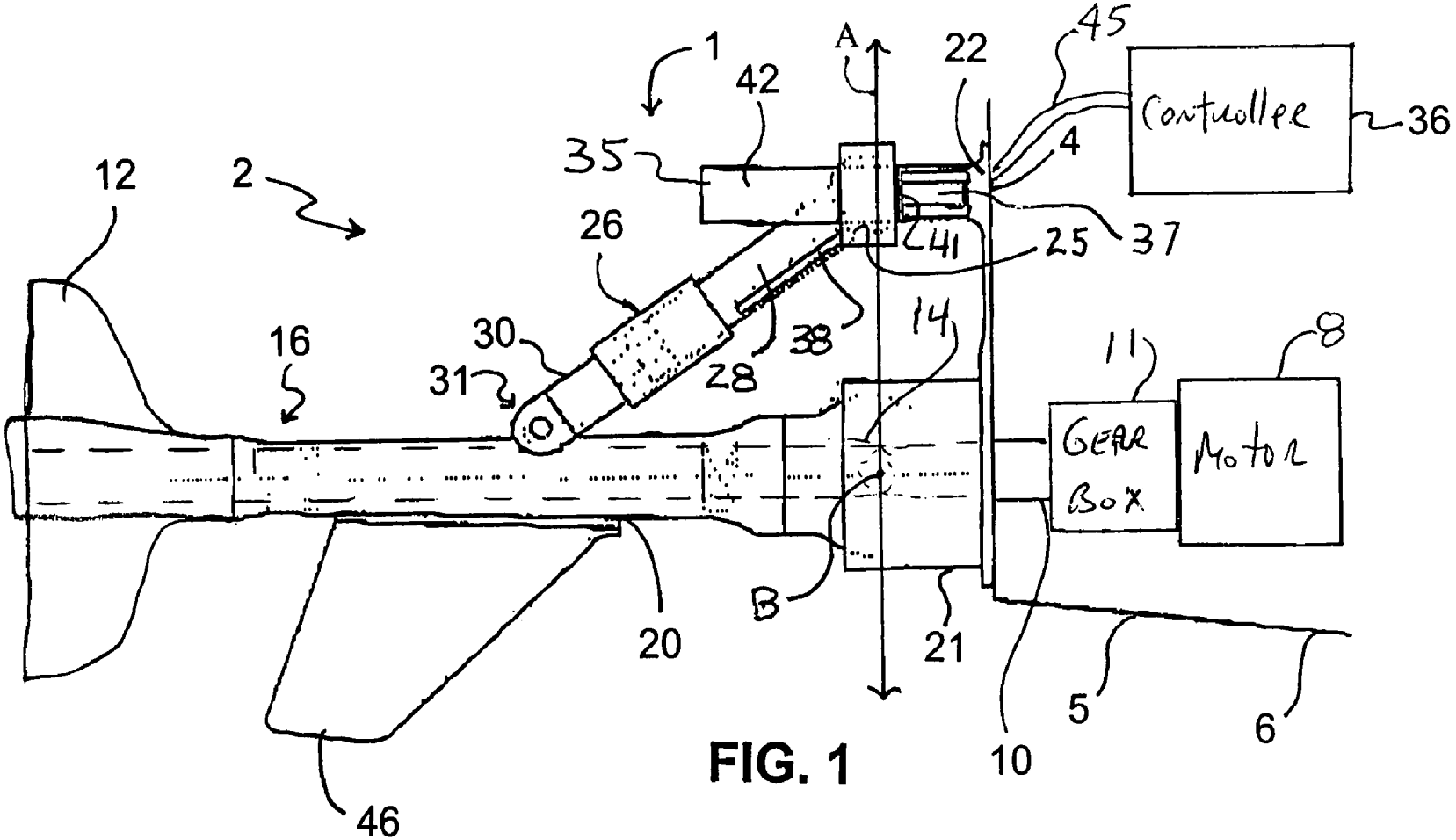
FIG. 1 is a diagrammatic side elevation view of the first embodiment.
Figure 2:
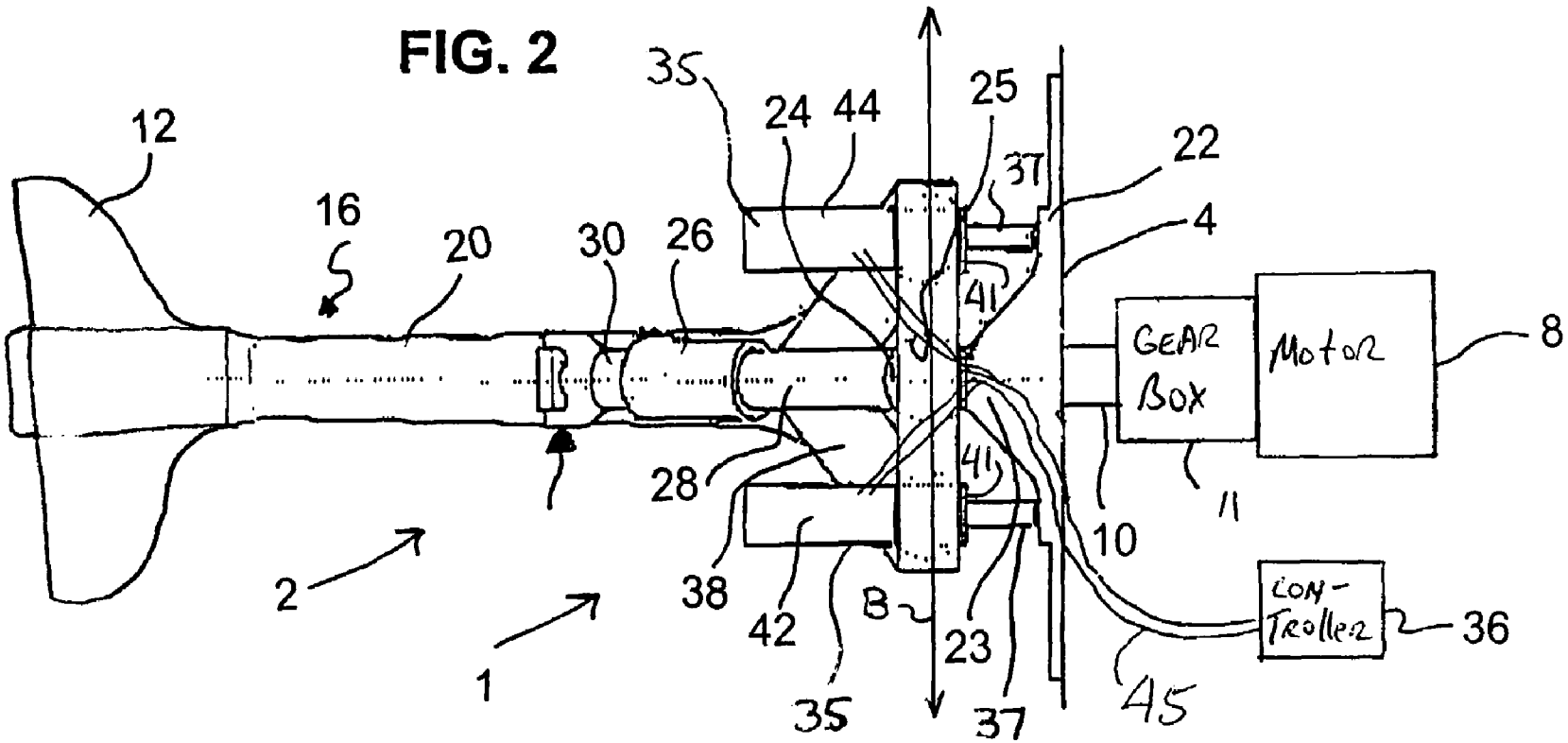
FIG. 2 is a diagrammatic top plan view of the first embodiment.
Figure 6:
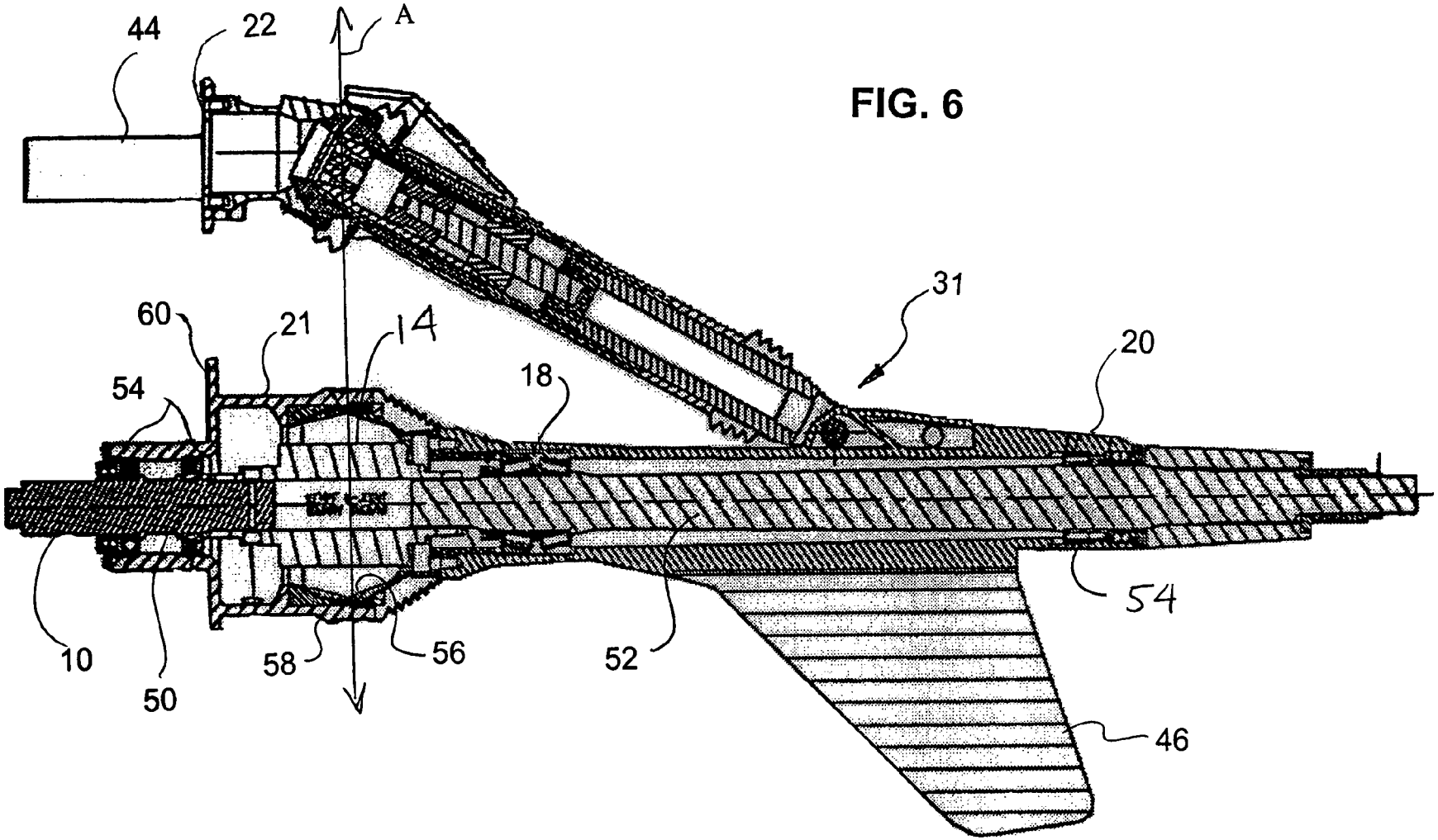
FIG. 6 is a diagrammatic cross-sectional view along section line 6—6 of FIG. 5.

With reference now to FIGS. 1 and 2, a first embodiment of the steering and trim marine outdrive system 1 will now be described. The marine outdrive 2 is mounted to transom 4 of a hull 5 of a marine vessel 6, such as a boat which is only partially shown in these Figures, in a conventional fashion with suitable fasteners and associated hardware (not shown in detail). An engine, drive or motor 8 is mounted within the marine vessel 6 and coupled, in a conventional manner, by an internal shaft to a gear box 11 and the drive shaft 10 for supplying rotational drive to the propeller 12 connected to a remote end of the marine outdrive 2. As is conventional in the art, a U-joint 14 (see FIG. 6) is located along the drive path, e.g., along the drive shaft 10, to permit vertical and/or horizontal movement of the remote propeller end 16 of the marine outdrive 2. In addition, the thrust generated by the propeller 12 of the marine outdrive 2, as the propeller 12 rotates in the water, is initially conveyed back along the drive shaft 10 until it reaches a thrust bearing 18 (see FIG. 6) where the generated propeller thrust is then conveyed radially outward to a thrust tube 20 which encases, surrounds and protect the drive shaft 10 and the U joint 14. The thrust tube 20 then conveys the generated propeller thrust forward, along the thrust tube 20, to a thrust socket 21 and finally to the transom 4 so that the generated thrust is ultimately transferred to the hull 5 and throughout a remainder of the marine vessel 6.

A leading end of the thrust socket 21 passes through an opening in the lower portion of the transom 4 and the thrust socket 21 is suitably sealed and secured to the transom 4 in a conventional manner, e.g., via suitable fasteners and a seal or gasket (not shown in detail). The drive shaft 10 extends through a central aperture formed in the thrust socket 21 and along a hollow passageway extending along the entire length of the thrust tube 20. One or more bearings 18, 54 (see FIG. 6) are provided, between the drive shaft 10 and the thrust tube 20, to facilitate rotation of the drive shaft 10 relative to the thrust tube 20 and the thrust socket 21. Due to this arrangement, the rotational drive from the motor 8 is supplied rearwardly along the drive shaft 10 while the generated propeller thrust is conveyed forwardly to the marine vessel, via the thrust tube 20, such that the drive shaft 10 does not experience any excess or unnecessary torque or stress during operation of the marine outdrive 2. As such supply of driving power and the conveyance of thrust is well known in the art, a further detail discussion concerning the same is not provided.

As illustrated in FIGS. 1 and 2, a transom plate 22 is secured to the transom 4 or rear portion of the hull 5 of the marine vessel 6 in a conventional fashion, e.g., with suitable fasteners and associated hardware (not shown in detail). The transom plate 22 has an extension member 23 which supports a socket housing 25 at a remote end thereof and the extension member 23 suitably spaces the socket housing 25 from the transom plate 22, e.g., by a distance of several inches or so. The socket housing 25 captively receives a linkage ball assembly 24 carried by one end of a support linkage 26 so that the linkage ball assembly 24 is able to move, pivot, spin and/or rotate within and the socket housing 25 while still being captively retained in the spaced relationship with the transom 4. The linkage ball assembly 24 pivotally connects a first end 28 of the support linkage 26 with the transom plate 22 to facilitate spinning, rotation and/or pivoting movement of the support linkage 26 relative to the transom plate 22. A second opposed end 30 of the support linkage 26 is pivotally connected to the remote propeller end 16 of the marine outdrive 2 by a C-bracket and pin assembly 31. This pivotal connection allows or facilitates pivotal movement of the remote propeller end 16 relative to the support linkage 26, along a plane defined by the support linkage 26 and the propeller end 16 of the marine drive, and facilitates up and down vertical trim adjustment of the marine drive 2.

The linkage ball assembly 24 and the U-joint 14, located along the drive path of the marine outdrive 2, together define a first pivot axis A for the propeller end 16 of the marine outdrive 2. That is, the first pivot axis A facilitates horizontal adjustment, i.e., left and right turning or steering, of the propeller end 16 of the marine outdrive 2. The linkage ball assembly 24 also defines a second pivot axis B which intersects with but extends normal to the first pivot axis A. The second pivot axis B facilitates vertical adjustment, i.e., up and down trim adjustment, of the propeller end 16 of the marine outdrive 2.

Figures 7, 8, 9:
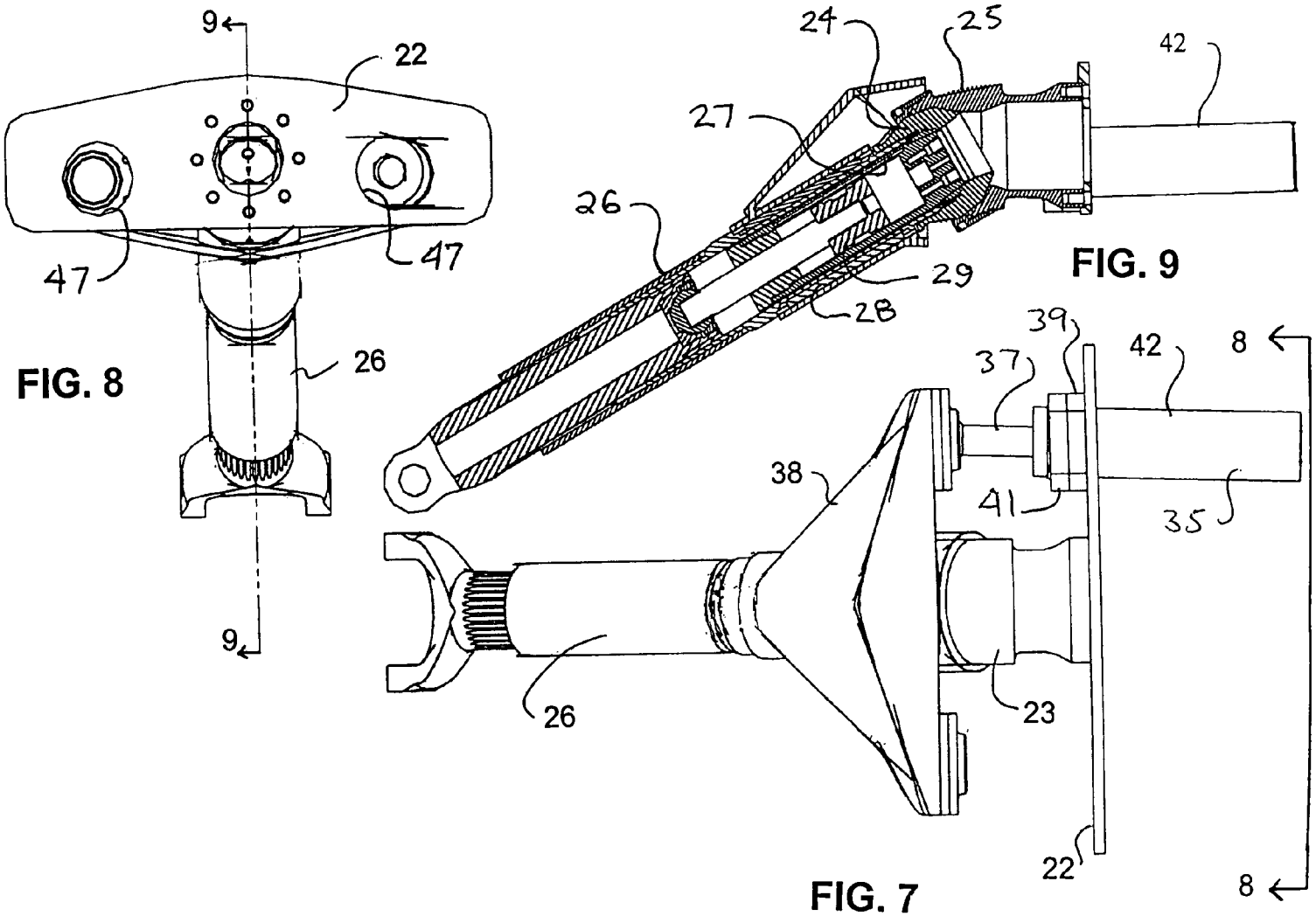
FIG. 7 is a diagrammatic top plan view of the support linkage of FIG. 3 prior to installation with a remainder of the marine outdrive.
FIG. 8 is a diagrammatic end elevational view along section line 8—8 of FIG. 7.
FIG. 9 is a diagrammatic cross-sectional view along section line 9—9 of FIG. 8.

According to the embodiment shown in FIGS. 1 and 2, the support linkage 26 is of a telescoping design, i.e., the support linkage 26 comprises a first arm 28 having a first end supporting the linkage ball assembly 24 and a second end which defines a piston chamber 27 therein and slidably receives a first end of a second arm 30, carrying a piston head 29 (see FIG. 9), to facilitate adjustment of the overall axial length of the support linkage 26. The second end of the second arm 30 is pivotally connected, via the C-bracket and pin assembly 31, to the propeller end 16 of the marine outdrive 2 at a location spaced from the propeller 12. When hydraulic fluid is supplied to the piston chamber 27, on either a first side or the opposite side of the piston head 29, the hydraulic fluid causes movement of the piston head 29 to move within the piston chamber 27 in one direction or the other and thus cause relative movement of the first and second arms 28, 30 with respect to one another, in a conventional manner. Such relative movement either increases (lengthens) or decreases (shortens) the overall axial length of the support linkage 26 to thereby provide a vertical raising or lowering trim adjustment, e.g., the "up" or "down" movement, of propeller end 16 of the marine outdrive 2 about the U-joint 14, i.e., the vertical axis B, of the drive shaft 10. Hydraulic fluid is typically utilized to control relative movement of the first and second arms 28, 30 with respect to one another although alternative designs for achieving such movement would be apparent to those skilled in the art and are considered to be within the spirit and scope of this invention. Preferably, the support linkage 26 is able to adjust its overall axial length over a sufficient range of movement so as to provided the necessary trim adjustment of the marine outdrive 2.

The support linkage 26 is preferably designed to absorb and accommodate substantially all of the torsional and bending loads from the marine outdrive 2 as well as the loads required to position the thrust tube 20 at a desired trim angle. The support linkage 26 may contain an internal trim actuator (not shown in detail) to provide the required axial forces for maintaining the desired drive trim angle. The trim actuator may contain either an internal or an external axial position sensor (not shown in detail) for detecting the actual trim position of the marine outdrive 2 and conveying this detected position to a controller 36, typically accommodated within the marine vessel 6, of the steering and trim marine outdrive system 1. In a preferred form of the invention, the linkage ball socket assembly 25 is sufficiently hollow to allow the associated hydraulic conduit and electrical lines 45 to pass therethrough and into a leading end of the linkage ball assembly 24 to facilitate communication between the support linkage 26, the steering actuators 40, 42 and trim actuator and the controller 36 of the marine vessel 6 located within the marine vessel 6.

A steering yoke 38 is fixedly attached to the first arm 28 of the support linkage 26, adjacent the linkage ball assembly 24, and extends over and covers the linkage ball assembly 24. An intermediate section of a first actuator arm 35 of a steering drive or actuator 42 is pivotally attached, e.g., via a ball and socket assembly, to one side or remote end of the steering yoke 38 while an intermediate section of a first actuator arm 35 of a second steering drive or actuator 44 is pivotally attached, e.g., via a ball and socket assembly, to an opposite side or free end of the steering yoke 38.

One manner of achieving such pivotal attachment is to form a ball component (not shown in detail) on the exterior surface of the first actuator arm 35, adjacent the location where the first actuator arm 35 receives the second actuator arm 37, and to captively sandwich this ball component between a pair of mating clamps 41 (only one of which is shown in FIGS. 1 and 2) which are securely fastened, by conventional fasteners and hardware, to the steering yoke 38. The pair of mating clamps 41 together form a socket for the ball component and allow pivoting movement of the first actuator arm 35 relative to the steering yoke 38. The free end of each of the first actuator arms 35 extends through an opening in the steering yoke 38 away from both the transom 4 and the steering yoke 38 and remains free to move over a limited range of movement. The opposite ends of each one of the second actuator arms 37 of the steering actuators 42, 44 is attached to the transom plate 22, e.g., via a ball and socket assembly, or affixed directly to the transom 4 of the marine vessel 6 so as to allow limited pivoting movement of the second actuator arms 37 relative to the transom plate 22 and/or the transom 4. The attachments of each of the steering actuators 42, 44, to the steering yoke 38 and the transom plate 22 and/or the transom 4, are spaced from one another by a sufficient distance so to provide sufficient leverage to the steering yoke 38 to facilitate steering of the marine outdrive 2.

The steering actuators 42, 44 may be, for example, a pair of hydraulic cylinders or actuators, a pair of screw drives, etc., or a variety of other actuation devices which are capable of supplying power or drive to the steering yoke 38 in order to facilitate rotation, spinning, turning and/or steering of the marine outdrive 2. The steering yoke 38 may be either formed separately from the support linkage 26 and thereafter fixedly secured thereto or the steering yoke 38 may be formed integral with the support linkage 26. As the steering actuators 42,44 only require limited pivoting movement in order to control steering, other types of pivoting connections, e.g., brackets and pivot pins, etc., which are known in the art may be utilized instead of the disclosed ball and socket arrangements.

The steering actuators 42, 44 are designed to operate in conjunction with one another. That is, as the first steering actuator 42 is actuated to increase its length so that the associated coupled end of the steering yoke 38 is moved generally away from the transom 4, the second opposed steering actuator 44 is simultaneously actuated to decrease its length so that the associated coupled end of the steering yoke 38 is generally moved toward the transom 4 a corresponding distance, and vice versa, so that the steering yoke 38 and the support linkage 26 both pivot about the linkage ball assembly 24 accommodated by the socket housing 25 of the transom plate 22, i.e., about first pivot axis A. Due to this arrangement, both of the steering actuators 42, 44 develop a pure force coupling around the linkage ball/socket assembly 24,25 which is substantially located along the pivot axis A of the marine outdrive 2 and coincident with a center of the U-joint 14. Accordingly, the present invention, unlike the above discussed prior art, does not impart any excessively large reactive side loads on the hull 5 nor does it impart any extraneous axial loads on the marine outdrive 2.

The propeller end 16 of the marine outdrive 2 has a vertical downwardly directed skeg 46, located between the propeller 12 and the thrust socket 21, which provides stability for the marine outdrive 2 during operation thereof. The skeg 46 is fin shaped, as is well known in the art, and configured so as to reduce drag as the skeg 46 glides through the water during operation of the marine outdrive 2.

Figure 1A:
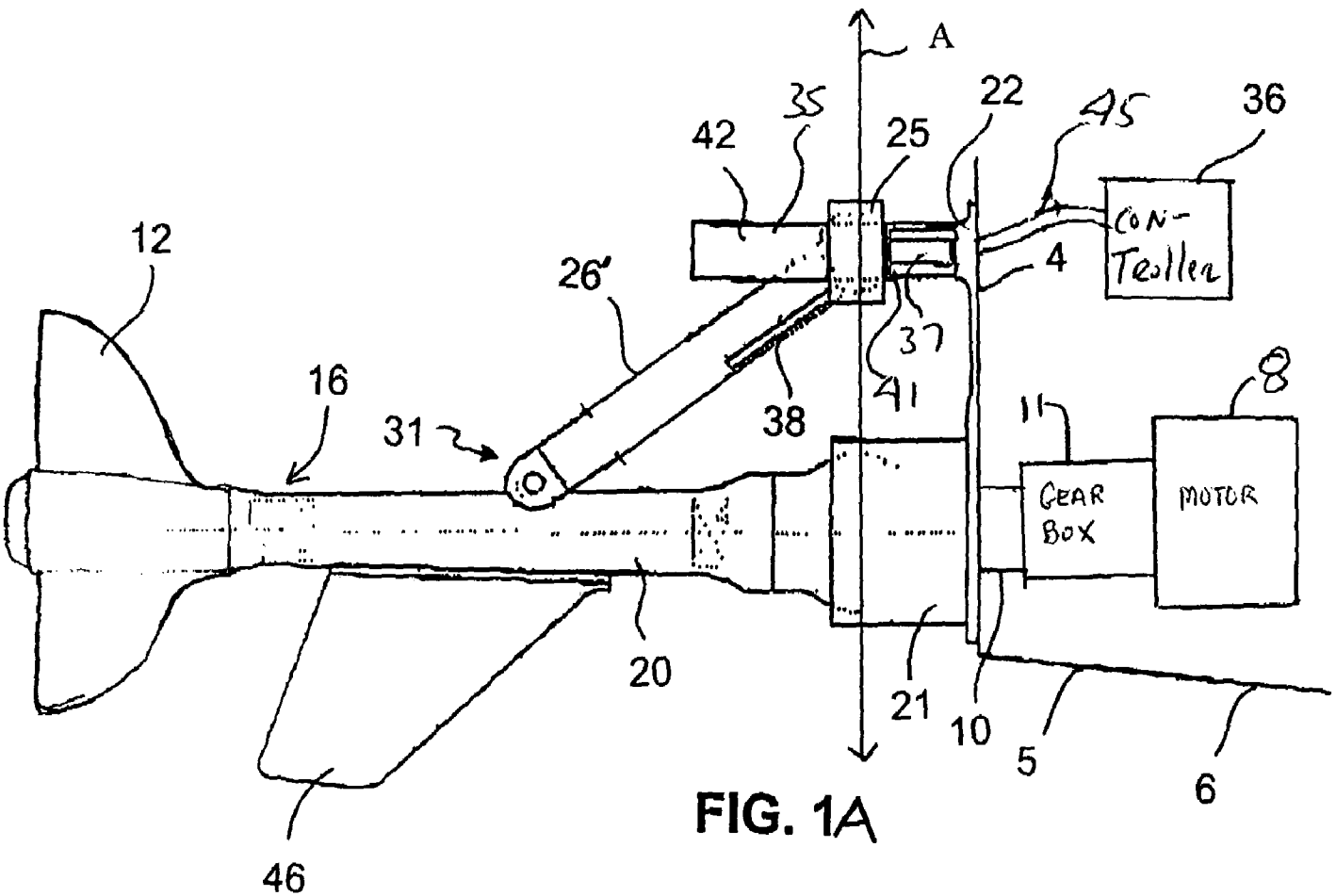
FIG. 1A is a diagrammatic side elevation view showing a modification of the first embodiment in which the support linkage has a fixed length.

Turning now to FIG. 1A, a minor modification of the first embodiment will be briefly discussed. As this embodiment is very similar to the first embodiment, only the variations between this embodiment and the prior embodiment will be discussed in detail.

As shown in FIG. 1A, the support linkage 26' is a fixed length member which does not allow any relative increasing or decreasing of the length of the support linkage 26' and thus adjustment of the trim of the marine outdrive 2. The support linkage 26' is attached to the thrust tube 20 via a C-bracket and pin assembly 31. The linkage ball assembly 24, according to this embodiment, only needs to accommodate horizontal to and fro movement, i.e., left and right steering, of the marine outdrive 2 about pivot axis A and does not accommodate any vertical trim adjustment.

With reference now to FIGS. 3 through 9, a second embodiment of the steering and trim marine outdrive will now be described. Like or similar elements in this embodiment with be given the same reference numerals.

According to the second embodiment, the orientation of the steering actuators 42, 44 are reversed. That is, the piston chambers for both of the steering actuators 42, 44 are accommodated generally inside the marine vessel 6 such that the transom 4 separates the piston heads and piston chambers (not shown in detail) of the steering actuators 42, 44 from a remainder of the steering actuators 42, 44. This embodiment represents the preferred orientation for the steering actuators 42, 44 since protection is provided for the steering hydraulic conduits and electrical wires 45 from the marine environment and assists with easier access to these components.

The transom plate 22 is secured to the outwardly facing surface of the transom 4 and this plate facilitates securing the steering actuators 42, 44 in a spaced relationship. A ball component (not shown in detail) is formed on the exterior surface of the first actuator arm 35, adjacent the location where the first actuator arm 35 receives the second actuator arm 37, and a pair of mating clamps 39, 41 captively sandwich the ball component therebetween. The pair of mating clamps 39, 41 are securely fastened to the transom plate 22 in a conventional manner by suitable fasteners and hardware. The pair of mating clamps 39, 41 together form a socket for the ball component and allow pivoting movement of the first actuator arms 35 relative to the transom plate 22. The free end of each of the first actuator arms 35 extends through one of the spaced apart oversized holes 47 in the transom plate 22 away from both the transom plate 22 and the steering yoke 38 and remains free to move over a limited range of movement. The free end of each one of the second actuator arms 37 is attached, e.g., via a ball and socket assembly, to the steering yoke 38 so as to allow limited rotation, spinning, and/or pivoting movement of the second actuator arms 37 relative to the steering yoke 38. The attachments of each of the steering actuators 42, 44, to the steering yoke 38, are spaced sufficiently from one another so to provide sufficient leverage to the steering yoke 38 to facilitate steering of the marine outdrive 2. Since all of the hydraulic conduits and electrical wires 45 for the steering actuator 42, 44 are accommodated substantially completely within the interior of the marine vessel 6, these components remain isolated and protected from the marine environment. In addition, this arrangement facilitates inspection and/or trouble shooting of the hydraulic conduits and electrical wires 45, especially when the marine vessel 6 is floating on a body of water.

With particular reference to FIGS. 4–7, a further detailed description concerning the transmission of drive from the motor 8 to the propeller 12 will now be described. The drive shaft 10 generally comprises a main drive shaft 50 which is at least partially accommodated by the thrust socket 21, e.g., the portion of the drive shaft 10 extending from the gear box 11 to the U-joint 14, and a propeller drive shaft 52 accommodated by the thrust tube 20 and coupled to the propeller 12. The main drive shaft 50 and the propeller drive shaft 52 are coupled to one another by the U-joint 14. At least one thrust bearing 18 is supported along the propeller drive shaft 52 to facilitate rotation of the propeller drive shaft 52 relative to the thrust tube 20. In addition, at least one other bearing 54 is provided between the main and propeller drive shafts 50, 52 and the thrust socket 21 and the thrust tube 20 to facilitate relative rotation between those components.

The leading edge of the thrust tube 20 includes a ball assembly 56 which is captively received within a ball socket assembly 58 of the thrust socket 21 to allow the thrust tube 20, and the accommodated propeller drive shaft 52, to pivot relative to the thrust socket 21 and provide for both horizontal and vertical adjustment of the propeller end 16 of the marine outdrive 2 relative to the thrust socket 21, about axes A and B. The thrust socket 21 includes a circular mounting plate 60 (see FIGS. 4–6) which facilitates mounting of the leading end of the marine outdrive 2 with an opening (not numbered) formed in lower portion of the transom 4 of the marine vessel 6 via a plurality of mounting apertures 62 formed within the mounting plate 60 and suitable fasteners and a seal or gasket (not shown).

Figure 3:
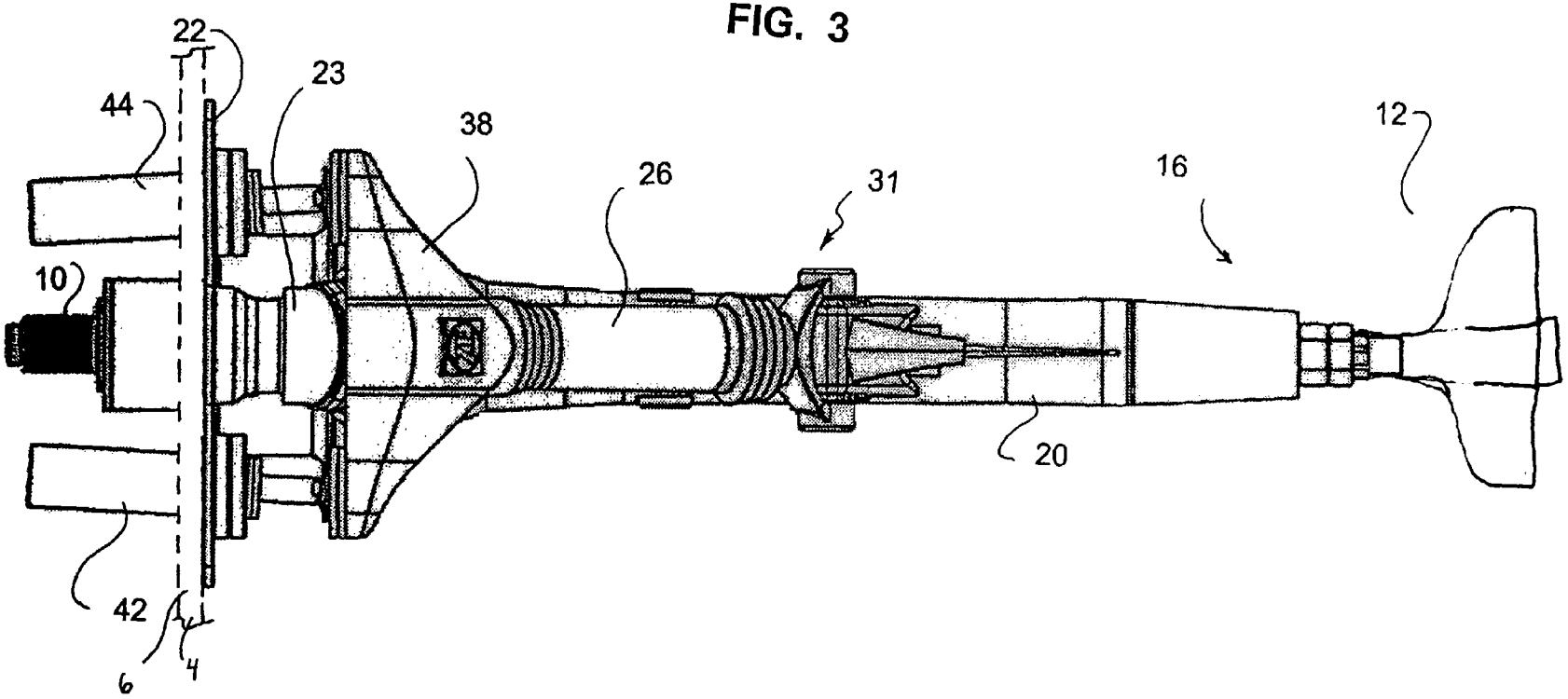
FIG. 3 is a diagrammatic top plan view of the second embodiment.
Figure 3A:
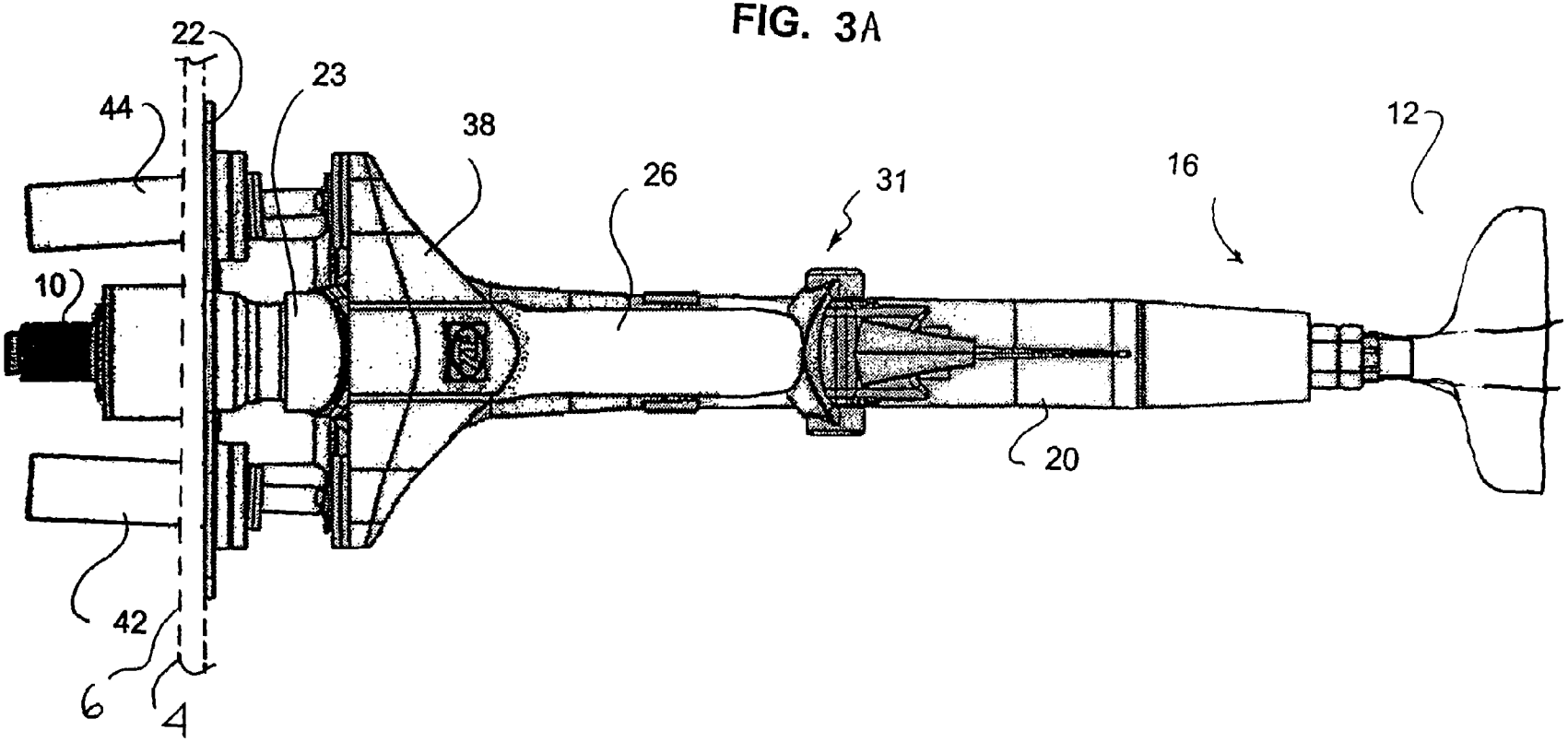
FIG. 3A is a diagrammatic plan view showing a modification of the second embodiment in which the support linkage has a fixed length.
Figure 4:
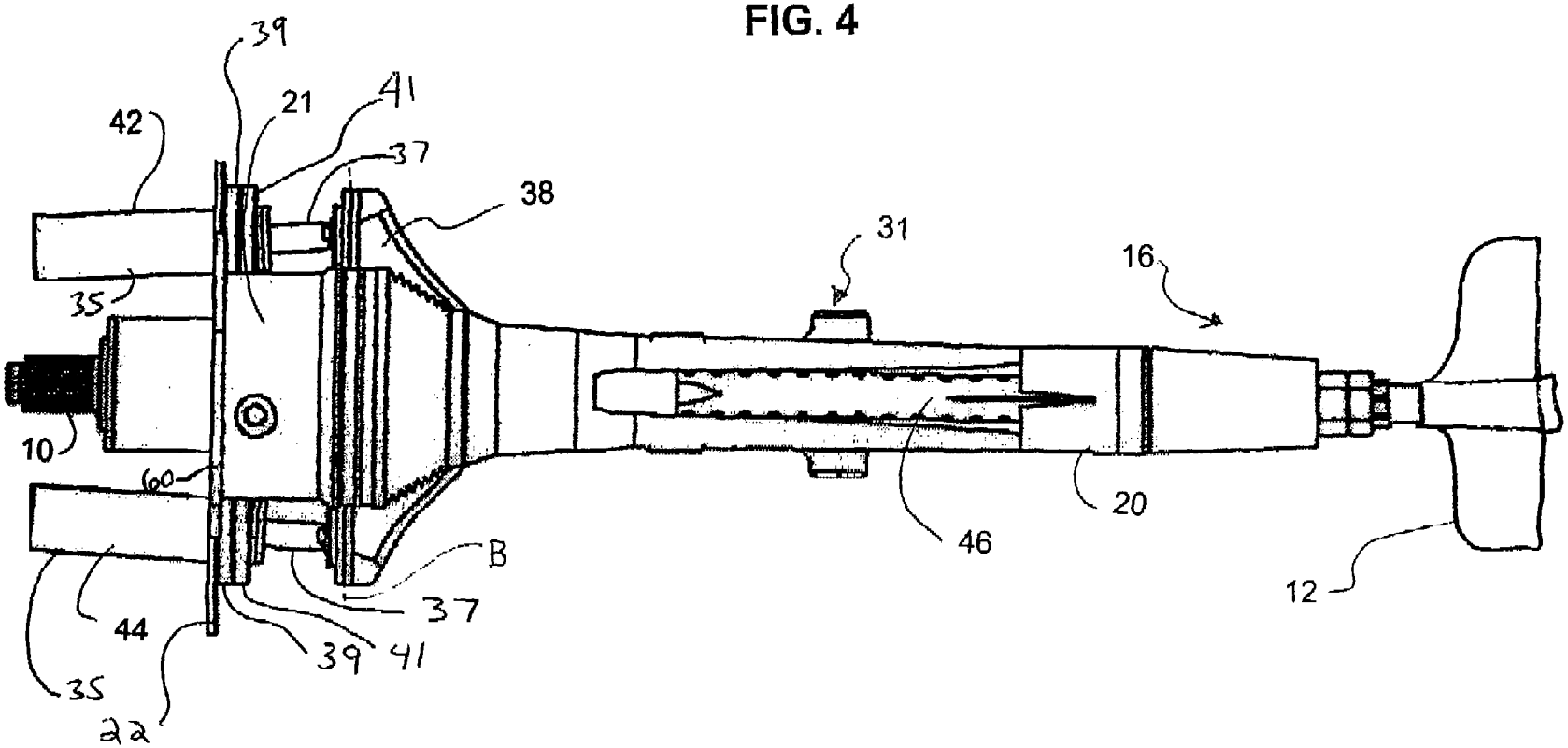
FIG. 4 is a diagrammatic bottom plan view of FIG. 3 with the marine vehicle removed for the sake of clarity.
Figure 5:
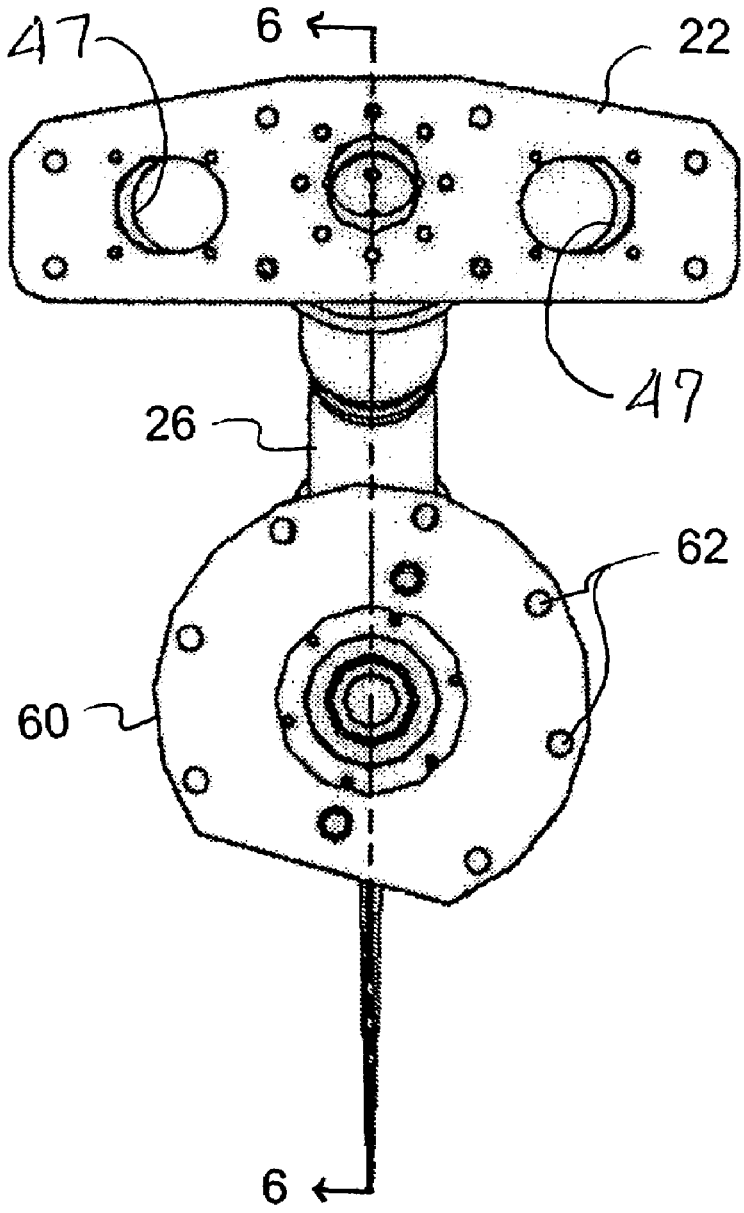
FIG. 5 is a diagrammatic end view of FIG. 3 with the marine vehicle removed for the sake of clarity.

Turning now to FIG. 3A, a minor modification of the second embodiment will be briefly discussed. As this embodiment is very similar to the second embodiment, only the variations between this embodiment and the prior embodiment will be discussed in detail.

As shown in FIG. 3A, the support linkage 26' is a fixed length member which does not allow any relative increasing or decreasing of the length of the support linkage 26' and thus adjustment of the trim of the marine outdrive 2. The support linkage 26' is attached to the thrust tube 20 via a C-bracket and pin assembly 31. The linkage ball assembly 24, according to this embodiment, only needs to accommodate horizontal to and fro movement, i.e., left and right steering, of the marine outdrive 2 about pivot axis A and does not accommodate any vertical trim adjustment.

According to the present invention, the propeller 12 is preferably is a surface piercing propeller, i.e., generally only the lower half or portion of the propeller 12 is submerged within the water during operation of the propeller. As is well known in the art, this type of propeller 12 generally generates about one half of the thrust and about one half of the power of a conventional propeller, but the overall efficiency of a surface piercing propeller 12 is increased due to the substantially less drag of the propeller as it rotates within the water.

It is to be appreciated by that although the above description indicates that the ball assembly is carried by one component and the socket assembly carried by another mating component, it would be readily apparent to those skilled in the art that the locations of the ball assembly and the socket assembly can be reversed in relation to one another. Alternatively, other known mechanisms and arrangements, which facilitate limited pivotally motion of the coupled or interconnected components with respect to one another, may be utilized without departing from the spirit and scope of the present invention.

Since certain changes may be made in the above described the steering and trim marine outdrive, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A steering and trim system for a marine outdrive comprising;

a marine outdrive having a propeller end for supporting a rotatable propeller and a mounting end for mounting the marine outdrive to a marine vessel, the marine outdrive comprising a main drive shaft coupled to a propeller drive shaft by a pivotal connection, the main drive shaft and the propeller drive shaft both lie substantially within a plane and being substantially collinear with one another for straight ahead travel of the marine drive;

a support linkage having a first end for attachment to a transom and a second end attached to the marine outdrive adjacent the propeller end thereof;

a steering yoke supported adjacent the first end of the support linkage; and first and second spaced apart steering actuators, a first end of each of the first and second steering actuators coupled to the steering yoke and a second end of each of the first and second steering actuators being connectable with the transom for facilitating steering of the marine outdrive.

2. The steering and trim system for a marine outdrive according to claim 1, wherein a motor supplies rotational drive to the marine outdrive via the main drive shaft, and the main drive shaft contains a U-joint which facilitates at least horizontal pivoting movement of the propeller end of the marine outdrive relative to the motor.

3. The steering and trim system for a marine outdrive according to claim 1, wherein the support linkage has a first end carrying a linkage ball assembly and a second end pivotally attached to the propeller end of the marine outdrive, the linkage ball assembly is captively received by a socket assembly of a transom plate, supported by the transom, to facilitate pivoting movement of the support linkage relative to the transom plate.

4. The steering and trim system for a marine outdrive according to claim 1, wherein the support linkage comprises a first arm and a second arm which are movable relative to one another to facilitate adjustment of a trim of the marine outdrive.

5. The steering and trim system for a marine outdrive according to claim 1, wherein the steering yoke is formed integral with the support linkage.

6. The steering and trim system for a marine outdrive according to claim 3, wherein the first and second steering actuators are coupled to and controlled by a controller such that when the first steering actuator is moved in a first direction, the second steering actuator is simultaneously moved a corresponding distance in an opposite direction such that the support linkage pivots about the socket assembly of the transom plate and when the first steering actuator is moved in a second direction, the second steering actuator is simultaneously moved a corresponding distance in an opposite first direction such that the support linkage pivots about the socket assembly of the transom plate.

7. A steering and trim system for a marine outdrive comprising:

a marine outdrive having a propeller end for supporting a rotatable propeller and a mounting end for mounting the marine outdrive to a marine vessel;

a support linkage having a first end for attachment to a transom and a second end attached to the marine outdrive adjacent the propeller end thereof;

a steering yoke supported adjacent the first end of the support linkage; and first and second spaced apart steering actuators, a first end of each of the first and second steering actuators coupled to the steering yoke and a second end of each of the first and second steering actuators being connectable with the transom for facilitating steering of the marine outdrive;

the marine outdrive comprises a main drive shaft coupled to a propeller drive shaft by a U-Joint, and a thrust socket supports the main drive while a thrust tube accommodates the propeller drive shaft and the U-joint interconnects the main drive shaft with the propeller drive shaft.

8. The steering and trim system for a marine outdrive according to claim 7, wherein the thrust socket includes a socket assembly and a leading end of the thrust tube, opposite the propeller, accommodates a ball assembly which is captively received by the socket assembly of the thrust socket to facilitate pivoting movement of the propeller end of the marine outdrive relative to the thrust socket.

9. The steering and trim system for a marine outdrive according to claim 1, wherein the support linkage has a first end carrying a linkage ball assembly and a second end pivotally attached to the propeller end of the marine outdrive, the linkage ball assembly is captively received by a socket assembly supported by the transom to facilitate pivoting movement of the support linkage relative to the transom, and a ball and socket assembly of a steering linkage and a ball and socket assembly of the marine outdrive form a pivot axis for the propeller end of the marine outdrive.

10. The steering and trim system for a marine outdrive according to claim 1, wherein the support linkage comprises a fixed length member which prevents adjustment of a trim of the marine outdrive.

11. The marine outdrive system according to claim 1, wherein a lower portion of a thrust tube, opposite the support linkage, supports a skeg.

12. The steering and trim system for a marine outdrive according to claim 1, wherein each one of the first and second spaced apart steering actuators is a hydraulic assembly, with a first end thereof pivotally supported by the transom and a second end thereof pivotally coupled to the steering yoke.

13. The steering and trim system for a marine outdrive according to claim 1, wherein each one of the first and second spaced apart steering actuators is a screw drive assembly, with a first end thereof pivotally supported by the transom and a second end thereof pivotally coupled to the steering yoke.

14. A marine vessel with a marine outdrive steering and trim system, comprising:

a marine vessel having a transom;

a marine outdrive having a propeller end supporting a rotatable propeller and an opposed second end mounted with the transom of the marine vessel;

a support linkage having a first end attached to the transom and a second end attached to the marine outdrive adjacent the propeller end thereof;

a steering yoke supported adjacent the first end of the support linkage;

first and second spaced apart steering actuators, a first end of each of the first and second steering actuators coupled to the steering yoke and a second end of each of the first and second steering actuators being connectable with the transom for facilitating steering of the marine outdrive; and the marine outdrive comprising a main drive shaft coupled to a propeller drive shaft by a pivotal connection, the main drive shaft and the propeller drive shaft both lie substantially within a plane and being substantially collinear with one another in a straight ahead travel direction.

15. The marine vessel with the marine outdrive steering and trim system according to claim 14, wherein a motor supplies rotational drive to the marine outdrive via the main drive shaft, and the main drive shaft contains a U-joint which facilitates at least horizontal pivoting movement of the propeller end of the marine outdrive relative to the motor; and the support linkage has a first end carrying a linkage ball assembly and a second end pivotally attached to the propeller end of the marine outdrive, the linkage ball assembly is captively received by a socket assembly of the transom to facilitate pivoting movement of the support linkage relative to the transom.

16. The marine vessel with the marine outdrive steering and trim system according to claim 14, wherein the marine outdrive comprises the main drive shaft coupled to the propeller drive shaft by a U-joint, and a thrust socket supports the main drive shaft while a thrust tube accommodates the propeller drive shaft and the U-joint interconnects the main drive shaft with the propeller drive shaft, wherein the thrust socket includes a socket assembly and a leading end of the thrust tube, opposite the propeller, accommodates a ball assembly which is captively received by the socket assembly of the thrust socket to facilitate pivoting movement of the propeller end of the marine outdrive relative to the thrust socket.

17. The marine vessel with the marine outdrive steering and trim system according to claim 14, wherein the support linkage has a first end carrying a linkage ball assembly and a second end pivotally attached to the propeller end of the marine outdrive, the linkage ball assembly is captively received by a socket assembly supported by the transom to facilitate pivoting movement of the support linkage relative to the transom, and the ball and socket assembly of the steering linkage and the ball and socket assembly of the marine outdrive form a pivot axis for the propeller end of the marine outdrive.

18. The marine vessel with the marine outdrive steering and trim system according to claim 17, wherein the first and second steering actuators are coupled to and controlled by a controller such that when the first steering actuator is moved in a first direction, the second steering actuator is simultaneously moved a corresponding distance in an opposite direction such that the support linkage pivots about the socket assembly of a transom plate and when the first steering actuator is moved in a second direction, the second steering actuator is simultaneously moved a corresponding distance in an opposite first direction such that the support linkage pivots about the socket assembly of the transom plate.

19. The marine vessel with the marine outdrive steering and trim system according to claim 14, wherein the support linkage comprises a first arm and a second arm which are movable relative to one another to facilitate adjustment of a trim of the marine outdrive and the steering yoke is formed integral with the first arm of the support linkage.

20. A method of steering a marine outdrive comprising the steps of:

supporting a rotatable propeller at propeller end of a marine outdrive, and mounting an opposite end of the marine outdrive to a marine vessel, the marine outdrive comprising a main drive shaft coupled to a propeller drive shaft by a pivotal connection, and the main drive shaft and the propeller drive shaft both lie substantially within a plane;

attaching a first end of a support linkage to a transom and attaching a second end of the support linkage to the propeller end of the marine outdrive;

supporting a steering yoke adjacent the first end of the support linkage;

connecting a first end of each of first and second steering actuators with the steering yoke and connecting a second end of each of the first and second steering actuators with the transom such that the first and second steering actuators are spaced apart from one another; and controlling steering of the marine outdrive by simultaneously actuating the first and second steering actuators in opposite directions to cause the support linkage to pivot relative to the transom and cause the propeller drive shaft to pivot relative to the main drive shaft in the plane and form a steering angle therebetween and steer the marine outdrive, and coaxially aligning the propeller drive shaft with the main drive shaft in the plane for straight ahead travel of the marine outdrive.

* * * * *